US006089969A

United States Patent [19]

Chung et al.

[11] Patent Number: 6,089,969

[45] Date of Patent: Jul. 18, 2000

[54] POWDER-PROOF APPARATUS FOR A PECVD REACTOR CHAMBER

[75] Inventors: Min-Yuan Chung, Hsinchu; Bih-Tiao Lin, Ping Tung; Wen-Chang Tseng, Hsinchu, all of Taiwan

[73] Assignee: Vanguard International Semiconductor Corporation, Hsinchu, Taiwan

[21] Appl. No.: 09/054,344

[22] Filed: Apr. 2, 1998

[51] Int. Cl.[7] ..... B08B 15/02

[52] U.S. Cl. ..... 454/56

[58] Field of Search ..... 454/49, 56, 57, 454/187; 15/4

[56] References Cited

U.S. PATENT DOCUMENTS

| | | | |
|---|---|---|---|
| 1,977,386 | 10/1934 | Holes | 454/56 |
| 2,397,731 | 4/1946 | Fowler | 454/56 X |
| 4,505,190 | 3/1985 | Fink et al. | 454/56 |
| 5,262,578 | 11/1993 | Hall | 454/56 X |
| 5,316,794 | 5/1994 | Carlson et al. | 454/57 X |

*Primary Examiner*—Harold Joyce

*Attorney, Agent, or Firm*—Christensen O'Connor Johnson & Kindness PLLC

[57] ABSTRACT

A transparent powder-proof housing covers the heater block of a PECVD reactor chamber tightly, thereby to prevent from powder pollution while cleaning the interior of the reactor chamber. The transparent powder-proof housing has two outlets, one for connecting to a vacuum cleaner and the other for human operation inside the reactor chamber. The vacuum cleaner vacuums the powder dust out of the transparent powder-proof housing, thereby to largely reduce the powder pollution in a clean room and the chances to jeopardize human health.

2 Claims, 4 Drawing Sheets

POWDER-PROOF APPARATUS FOR A PECVD REACTOR CHAMBER

BACKGROUND OF THE INVENTION

A. Field of the Invention

The present invention relates to a powder-proof apparatus for a reactor chamber, especially to a reactor chamber of a PECVD (Plasma Enhanced Chemical Vapor Deposition) equipment to prevent powder pollution while cleaning the interior of the reactor chamber.

B. Description of the Prior Art

A PECVD reactor chamber uses plasma to form chemical deposition on the surface of a wafer and to reduce the temperature required for chemical reaction. A PECVD equipment includes the basic devices required for performing CVD such as a reactor chamber, a gas transmission system, an exhaust system, and a process control system. Additionally, it also includes a vacuum system for maintaining the plasma required for chemical reaction, a heat source and a plasma generator.

FIG. 1 shows a conventional Novellus PECVD 150 system. As FIG. 1 shows, the 150 system includes a RF Matching Network 11, a top plate 12, a Reactor Chamber 13, Reactor Foreline 14, Pneumatic Panel 15, Main AC Panel 16, Process Gas Panel 17, Purge Panel 18, and Facility Panel 19.

When cleaning the interior of the reactor chamber 13, first the top plate 12 is removed and then the reactor chamber 13 is allowed to cool down to room temperature. Then the upper chamber wall of the reactor chamber is removed to start cleaning the powder dust accumulated and crystallized on the surface of the heater block (not shown on FIG. 1). Since the powder dust is accumulated and crystallized on the surface of the heater block, an operator usually has to use a grinder to grind the powder dust off from the surface of the heater block. When the crystallized powder dust is ground, it is sent flying in the air and, spreading all over the clean room. Since the powder dust is poisonous, it can threaten human health seriously.

SUMMARY OF THE INVENTION

Accordingly, it is an object of the present invention to provide a simple and handy powder-proof apparatus which can efficiently prevent powder dust from polluting the clean room when performing maintenance on the reactor chamber, thereby reducing the chances of putting human health in jeopardy.

It is another object of the present invention to provide a simple yet efficient powder-proof apparatus which can be easily modified to fit any size of heater block without affecting its main functions.

Accordingly, the present invention provides a transparent powder-proof housing having an air outlet and an operation opening. The transparent powder-proof housing can fit a heater block tightly. The air outlet connects to a vacuum cleaner for vacuuming the powder dust out from the reactor chamber when grinding the crystallized powder dust. An operator can easily put his hands inside the transparent powder-proof housing through the operation opening to grind the crystallized powder dust.

BRIEF DESCRIPTION OF THE DRAWINGS

These and other objects and advantages of the present invention will become apparent by reference to the following description and accompanying drawings wherein.

DETAILED DESCRIPTION OF THE PREFERRED EMBODIMENTS

A preferred embodiment of the invention is described below. This embodiment is merely exemplary. Those skilled in the art will appreciate that changes can be made to the disclosed embodiment without departing from the spirit and scope of the invention.

Figure 1:
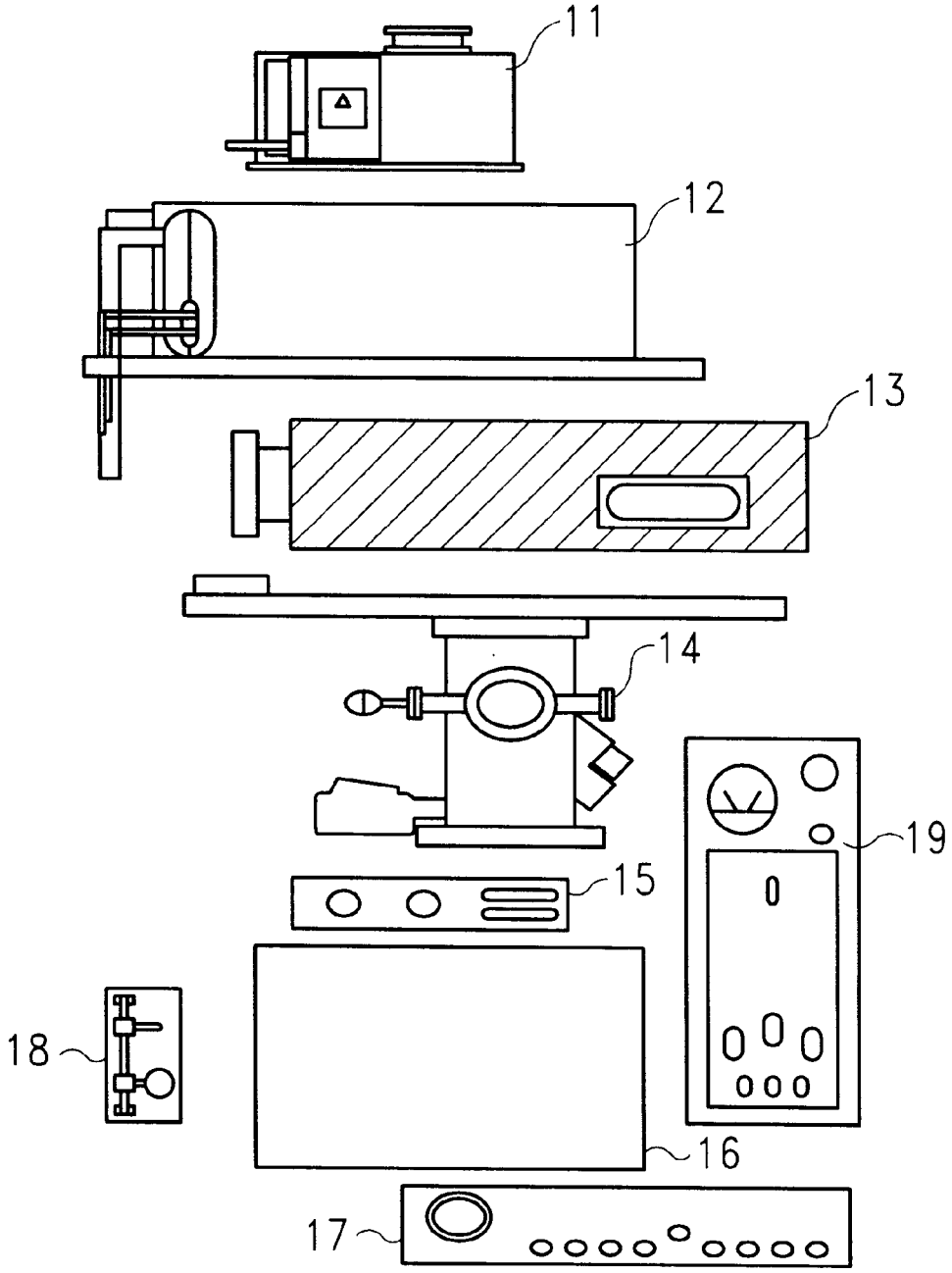
FIG. 1 (PRIOR ART)
FIG. 1 is a front view showing the outlook of conventional PECVD equipment.
Figure 2:
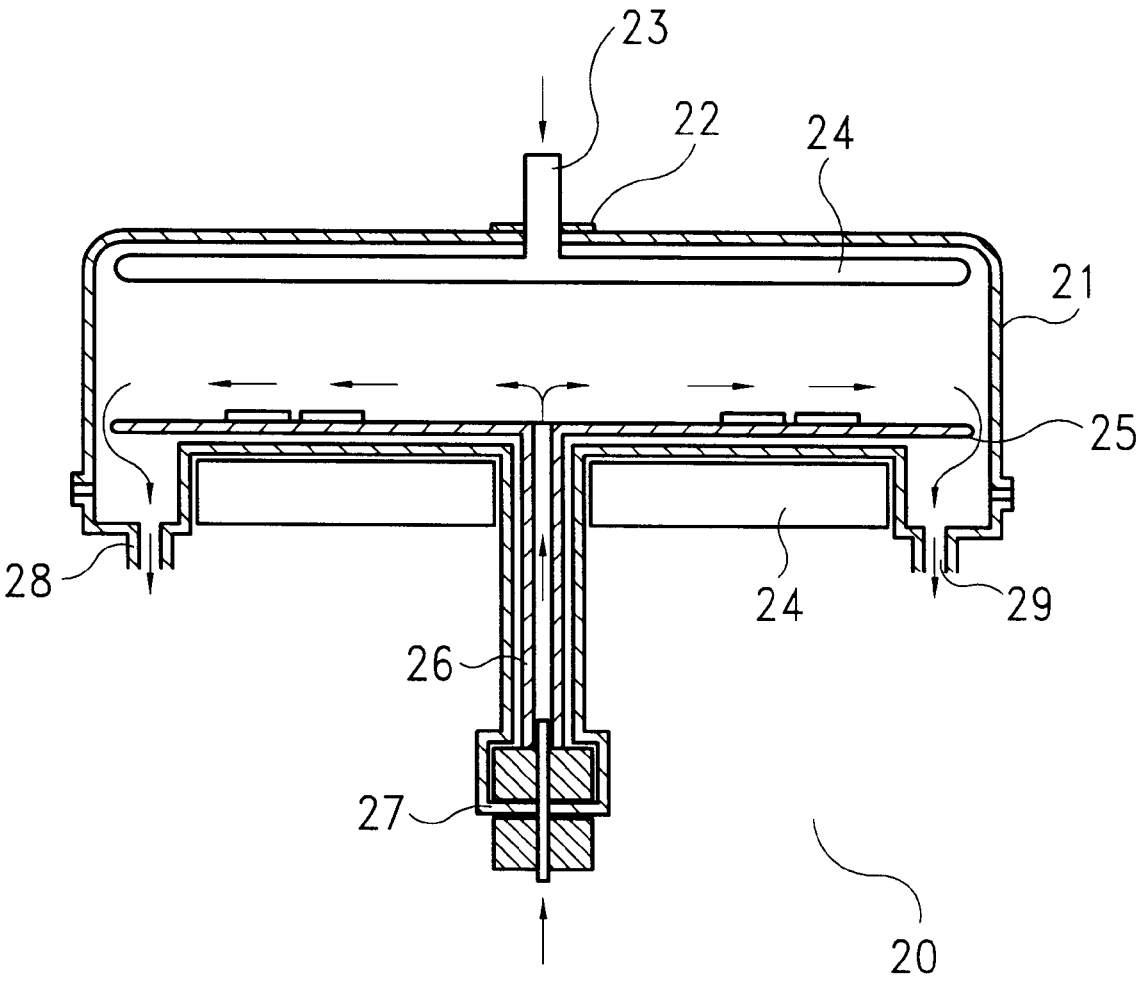
FIG. 2 is a sectional perspective view showing the structure of a batch type PECVD reactor chamber.

To solve the powder pollution problem as stated above, the invention provides a simple and efficient apparatus for preventing powder pollution in the clean room. Generally, the conventional reactor chambers for PECVD equipment can be classified as single-wafer type and batch type. The single-wafer type reactor chamber can process wafers one at a time while the batch type reactor chamber can process multiple wafers at one time. FIG. 2 illustrates the structure of a batch type reactor chamber 20. The basic structure of a single-wafer type reactor chamber is very similar to that of the batch type reactor chamber 20. They include a removable upper chamber wall 21 which is cylindrical. At the center of the cylindrical chamber wall 21, there is an inlet 22 for connecting to a RF power supply 23. The end of the RF power supply 23 is connected to a shower head 24 for providing an Electrode. A disk-like heater block 25 is located at the bottom of the reactor chamber 20. At the center of the heater block 25, there is a spin axle 26 that is hollow. The spin axle 26 is connected to a driver 27 for rotating the heater block 25. The lower end of the spin axle 26 is further connected to an air inlet 27 for allowing air to flow into the reactor chamber 20. On the opposite sides of the reactor chamber 20, there are two exhaust outlets 28, 29 for exhaust to flow out.

Figure 3:
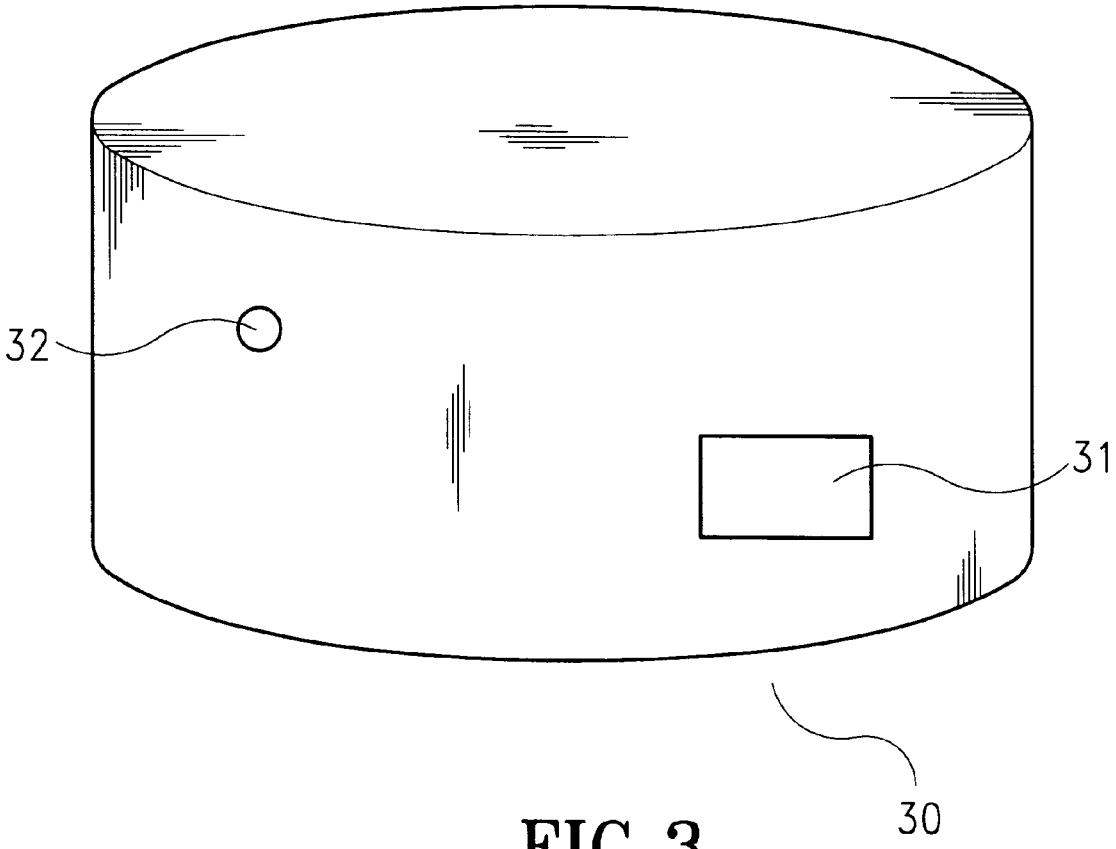
FIG. 3 is a perspective view showing the structure of the invention.

Refer to FIG. 3 for the structure of the inventive transparent powder-proof housing 30. The transparent powder-proof housing 30 is made of acrylic to see through. The size of the powder-proof housing 30 depends on the application. It must be able to cover the heater block tightly to prevent the powder dust from being stirred out. There are two openings in the sides of the transparent powder-proof housing to ease operation inside the powder-proof housing 30, one for air outlet 32, and the other for operation opening 31. The size of the operation opening 31 is about 12×20 cm. The diameter of the air outlet 32 is about 5 cm.

Figure 4:
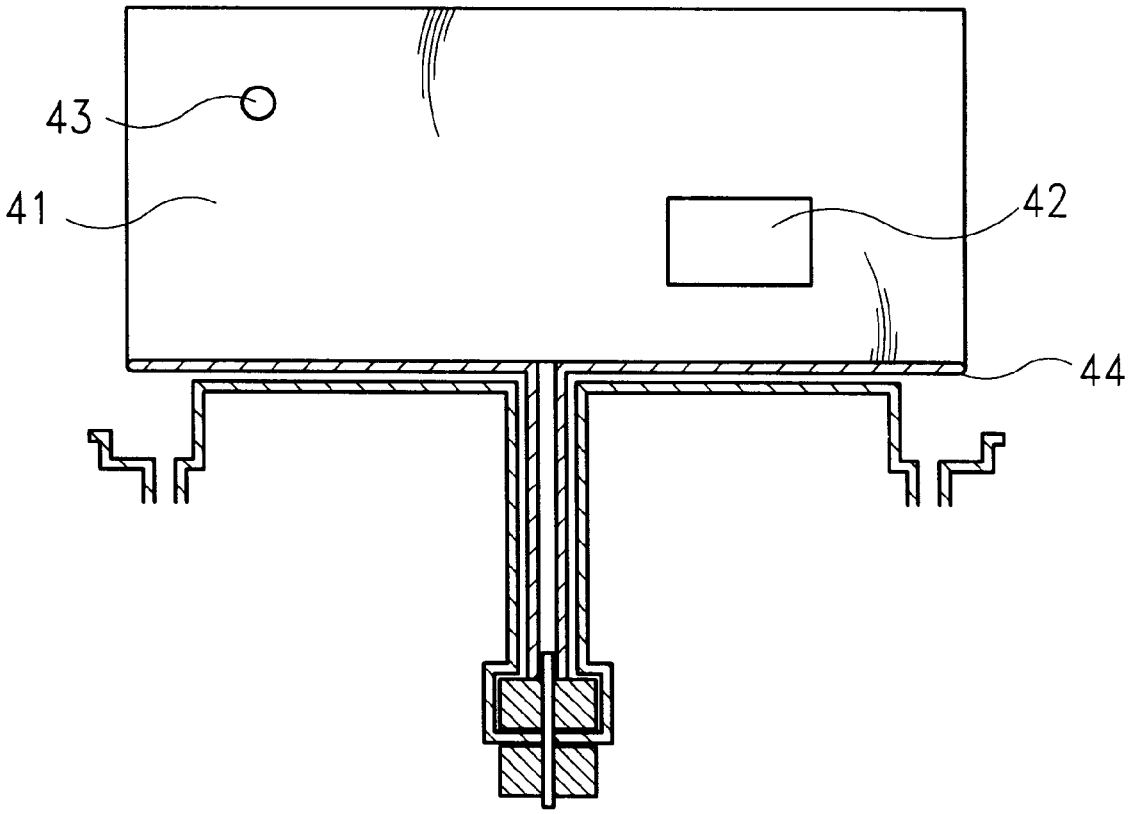
FIG. 4 is a schematic view showing the situation when the inventive powder-proof housing is put on the heater block for cleaning.

When doing regular maintenance on the reactor chamber 20, the reactor chamber 20 is allowed to cool down to room temperature. Then, the top plate 12 is removed. After that, the upper reactor wall 21 is removed and the heater block 25 is covered with the transparent powder-proof housing 30 as illustrated in FIG. 4. Then the vacuum cleaner 41 is connected to the air outlet 43 for vacuuming the powder dust produced in grinding the crystallized powder dust off from the surface of the heater block 44. An operator can maintain the reactor chamber 20 easily through the operation opening 42.

The invention is simple yet effective in preventing powder pollution in the clean room. It also keeps an operator away from hazardous working environment.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed:

1. A method for cleaning a Plasma Enhanced Chemical Vapor Deposition (PECVD) reactor chamber, the method comprising:

removing a top plate of said PECVD reactor chamber;

removing an upper reactor wall of said PECVD reactor chamber;

covering a heater block of said PECVD reactor chamber with a transparent housing;

placing a grinding tool through an operation opening of the transparent housing to grind powder off of the heater block;

connecting a vacuum cleaner to an air outlet of the transparent housing;

operating said vacuum cleaner to remove powder ground off of the heater block; and removing the transparent housing from the PECVD chamber.

2. The method of claim 1, further comprising manually grinding crystallized powder off of the surface of the heater block using the grinding tool.

* * * * *